US008833336B2

(12) United States Patent
Ernst

(10) Patent No.: US 8,833,336 B2
(45) Date of Patent: Sep. 16, 2014

(54) ENGINE DUST AND DIRT SHIELD OR COVER

(76) Inventor: Gregory R. Ernst, Eagle Creek, OR (US)

( * ) Notice: Subject to any disclaimer, the term of this patent is extended or adjusted under 35 U.S.C. 154(b) by 1223 days.

(21) Appl. No.: 12/611,608

(22) Filed: Nov. 3, 2009

(65) Prior Publication Data

US 2011/0100320 A1 May 5, 2011

(51) Int. Cl.
*F02B 77/04* (2006.01)
*F02F 7/00* (2006.01)
*F02B 77/02* (2006.01)

(52) U.S. Cl.
CPC ..... *F02B 77/02* (2013.01); *F02F 7/0073* (2013.01); *F02F 7/006* (2013.01)
USPC ..... 123/198 E; 123/198 C

(58) Field of Classification Search
CPC ..... F16J 15/061; F16J 15/0831; F16J 15/123; F16J 15/0825; F01M 11/0004; F02F 7/006; B23P 6/02; B23P 6/00
USPC ..... 123/195 R, 195 C, 198 E, 198 R; 29/888.01, 888.011, 888.012; 277/598, 277/600
See application file for complete search history.

(56) References Cited

U.S. PATENT DOCUMENTS 3,396,712 A * 8/1968 Sakraida et al. ..... 123/198 E
4,027,644 A * 6/1977 Timour ..... 123/198 E
4,279,224 A * 7/1981 Szabo et al. ..... 123/184.32
4,420,062 A * 12/1983 Fukushima ..... 181/204
4,495,903 A * 1/1985 Asano ..... 123/90.38
4,872,424 A * 10/1989 Carnes ..... 123/184.32
5,492,086 A * 2/1996 Kuhns ..... 123/90.38
5,657,100 A * 8/1997 Yamamoto et al. ..... 349/41
5,899,182 A * 5/1999 Martinsson et al. ..... 123/90.38
6,250,266 B1 * 6/2001 Okui et al. ..... 123/90.17
6,305,168 B1 * 10/2001 Furukawa ..... 60/605.1
6,371,073 B1 * 4/2002 Billimack et al. ..... 123/195 C
6,439,185 B2 * 8/2002 Tosaka et al. ..... 123/90.27
6,499,451 B1 * 12/2002 Hendriksma et al. ..... 123/90.16
7,255,079 B2 * 8/2007 Tripathy et al. ..... 123/90.38
7,441,533 B1 * 10/2008 Miller et al. ..... 123/198 E
7,451,735 B2 * 11/2008 Riley et al. ..... 123/195 C
7,814,880 B2 * 10/2010 Waters et al. ..... 123/195 C
7,934,480 B2 * 5/2011 Katayama et al. ..... 123/90.37
2006/0070599 A1 * 4/2006 Nonogaki et al. ..... 123/195 C
2008/0087247 A1 * 4/2008 Riley et al. ..... 123/198 E
2009/0173310 A1 * 7/2009 Sedlar et al. ..... 123/195
2010/0071654 A1 * 3/2010 Waters et al. ..... 123/195

* cited by examiner

*Primary Examiner* — Lindsay Low
*Assistant Examiner* — Syed O Hasan
(74) *Attorney, Agent, or Firm* — patenttm.us

(57) ABSTRACT

An engine cover system provides temporary reusable covers for engine blocks to protect against entry of foreign material into the engine when the head and manifolds are removed during repair, rebuild or transport both with used and new engine blocks. Manifold and head cover portions may be separately installed or installed in combination with clip members to attach the head and manifold cover portions to one another.

11 Claims, 15 Drawing Sheets

FIG. 14
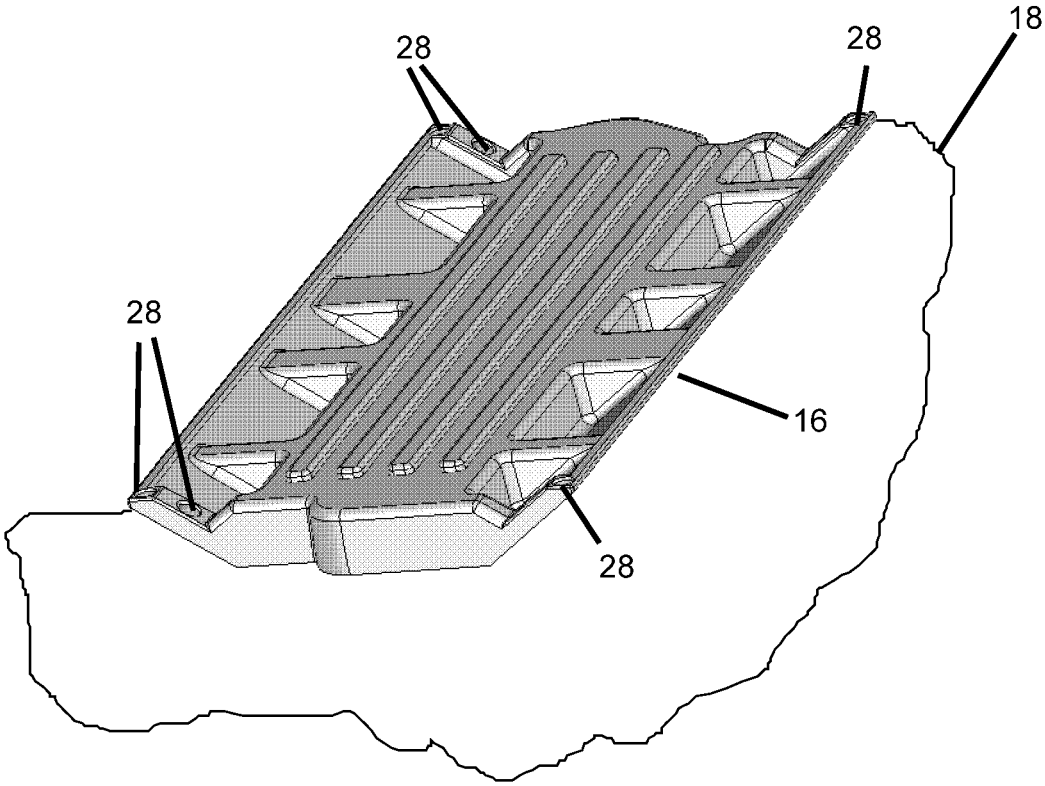
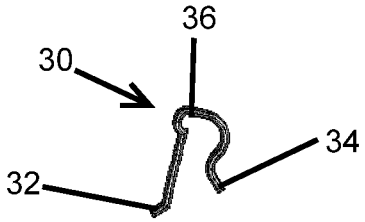
FIG. 15
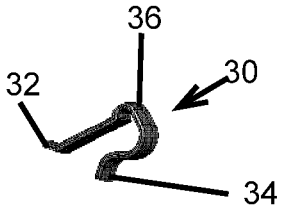
FIG. 16

ENGINE DUST AND DIRT SHIELD OR COVER

BACKGROUND OF THE INVENTION

This invention relates to engines, and more particularly to covers for protecting from foreign materials, dust, dirt and liquids from falling into the engine interior while the engine is in a disassembled or partially assembled state.

Many engines, for example V8 engines, from different manufactures are susceptible to dirt and foreign debris entering the engine when they are in partially disassembled condition. This is a particularly important issue when either intake manifolds or heads, or a combination thereof, has been removed from engine, such as during re-build or repair or initial building of new engines from an engine block.

When engines are repaired in shops, many types of repairs require removal of the intake manifolds and/or heads. While the repairs are in process, the engines may typically be stored in the shops in disassembled states for periods of time, without either intake manifolds and/or heads installed. When an intake manifold is removed it exposes the internal portion of the engine, which can lead to undesirable foreign material entering the engine.

To address these issues, sometimes when the engine is left open in a shop environment, the mechanics will use rags to cover the open portions of the engine to attempt to keep debris from entering the engine, but this method is not entirely satisfactory, as the rags can easily fall out or become dislodged, and may not provide a sufficient degree of prevention of foreign material entry.

Machine shops rebuild engines and often return them to customers without the intake manifold and/or heads installed. The transport of the rebuilt engine in this state provides further opportunity for undesired entry of foreign material into the engine.

Engines purchased in new condition sometimes do not come with an intake manifold and are shipped in plastic bags. Once the bag is opened or if the bag is punctured or ripped during shipment, further opportunity for undesired foreign material to enter the engine arises.

SUMMARY OF THE INVENTION

In accordance with the invention, an apparatus for protecting an engine against dirt or foreign material entry when the head and/or intake manifolds are removed includes a cam valley cover, and first and second head covers. The covers are adapted for mounting to the engine and can be employed together or separately for use in different situations.

Accordingly, it is an object of the present invention to provide an improved engine cover system for protecting engines against entry of foreign material when the engines are new or being rebuilt or repaired.

It is a further object of the present invention to provide an improved engine protection system for protection against entry of dirt to engines with heads or intake manifolds removed.

It is yet another object of the present invention to provide an improved system for protecting engines with reusable cover member for use during shipping, repair or rebuilding.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BRIEF DESCRIPTION OF THE DRAWINGS

FIG. 14 is a view of a cam valley cover alone;

FIG. 15 is a side view of a cover clip;

FIG. 16 is a perspective view of a cover clip; and

DETAILED DESCRIPTION

The system according to a preferred embodiment of the present invention comprises a one or more cover member adapted for placement over portions of the engine block when the engine is disassembled.

When an engine is bare without accessories and intake manifold but with heads it is called a "long block". When an engine is bare of accessories, intake manifold and is also without heads it is called a "short block".

Figure 1:
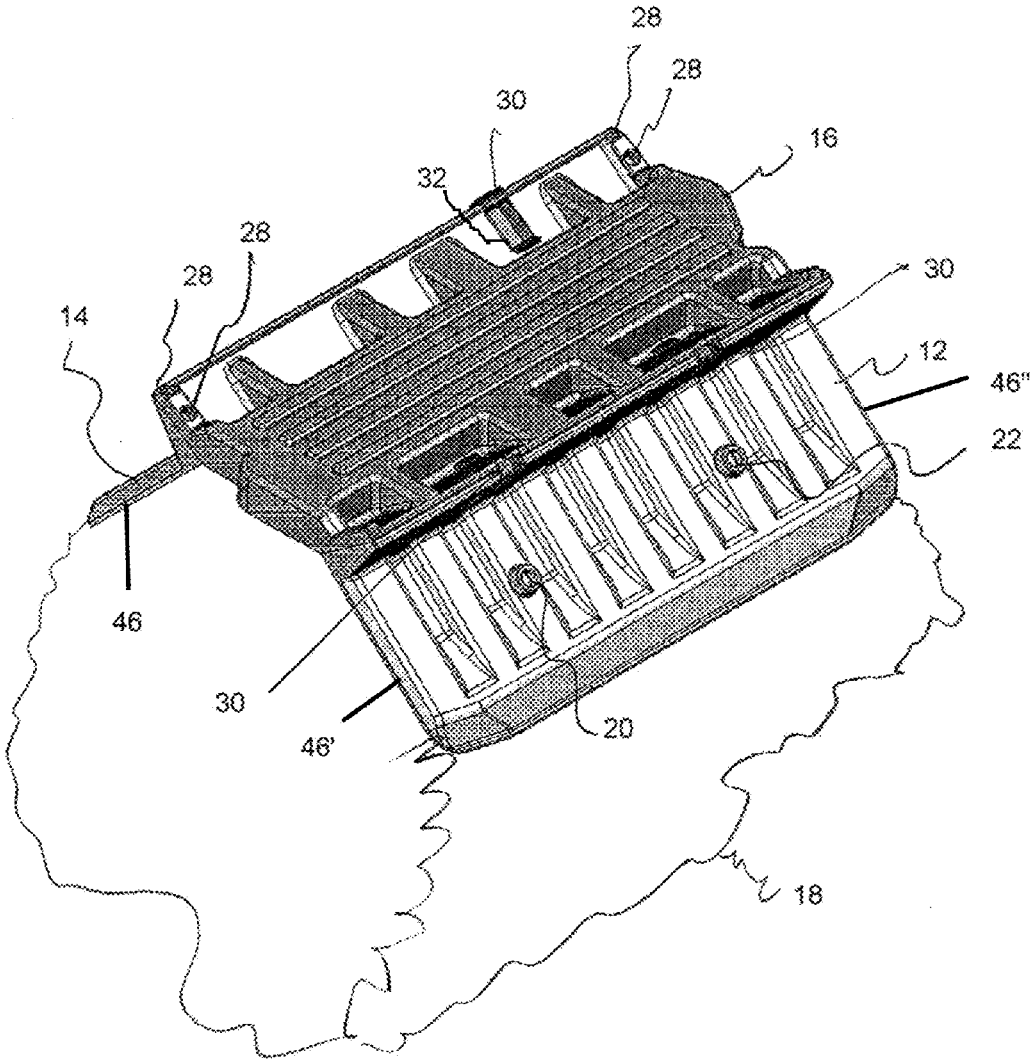
FIG. 1 is a perspective view of an engine block cover apparatus in accordance with the invention.
Figure 2:
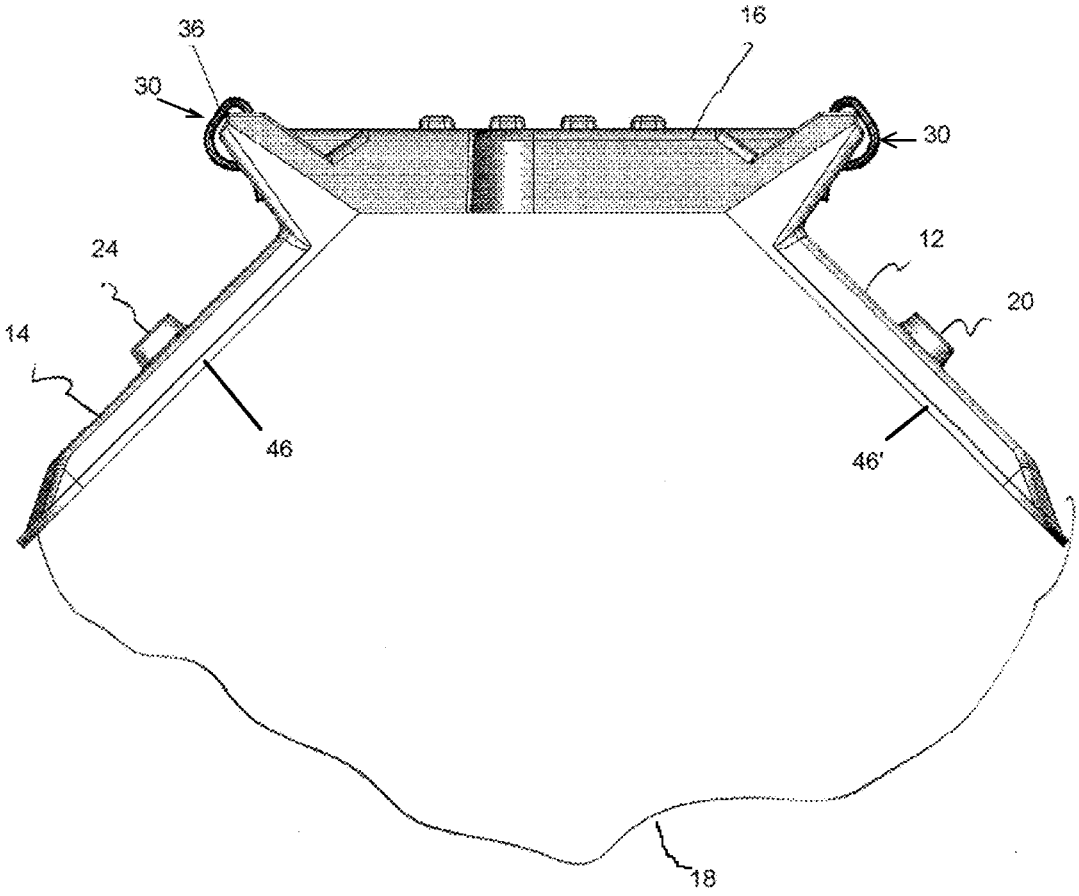
FIG. 2 is a front end view of the cover of FIG. 1.
Figure 3:
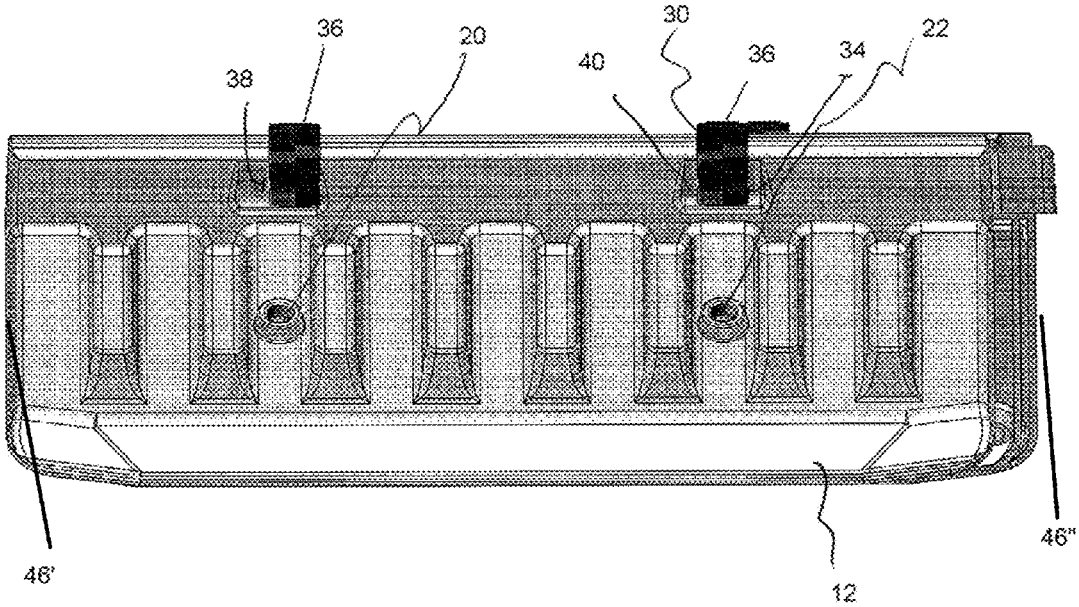
FIG. 3 is a left side view of the cover of FIG. 1.
Figure 4:
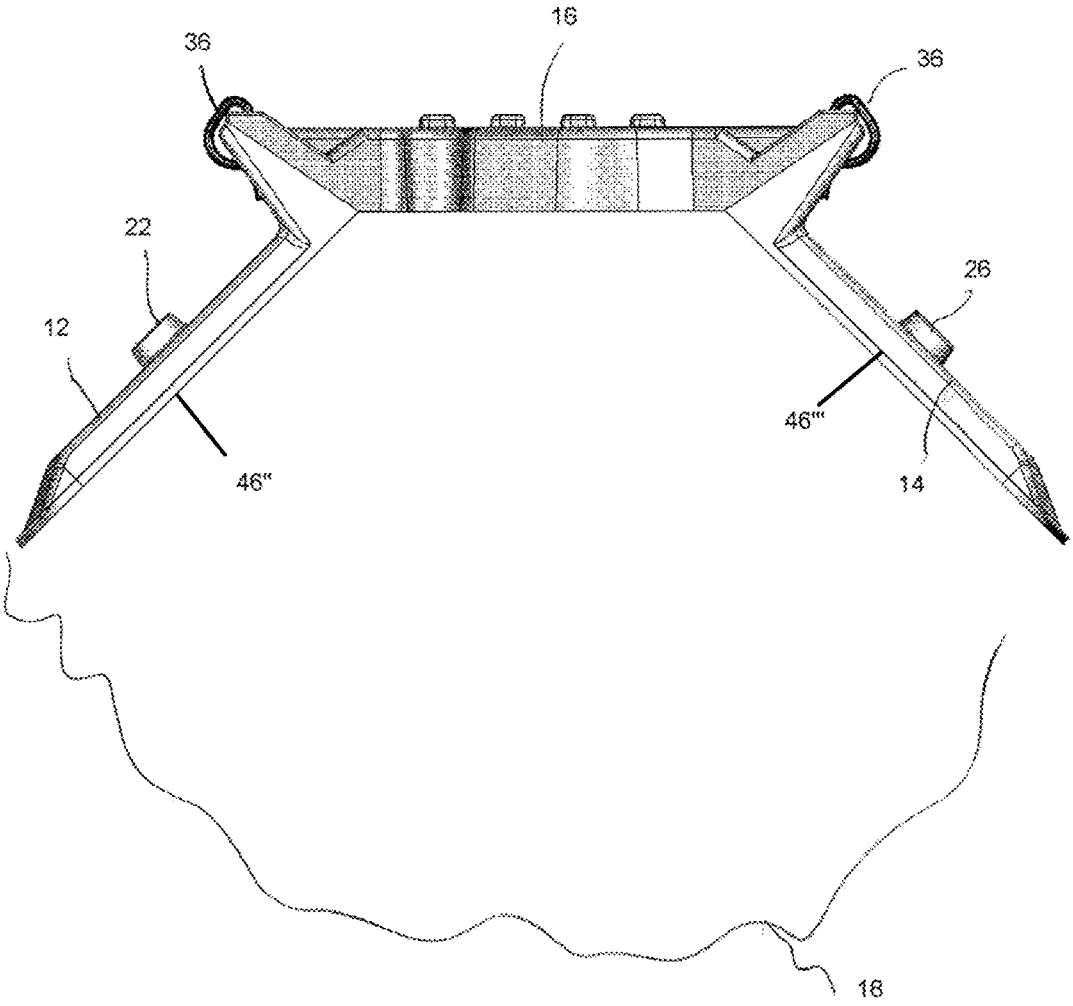
FIG. 4 is a rear end view of the cover of FIG. 1.
Figure 5:
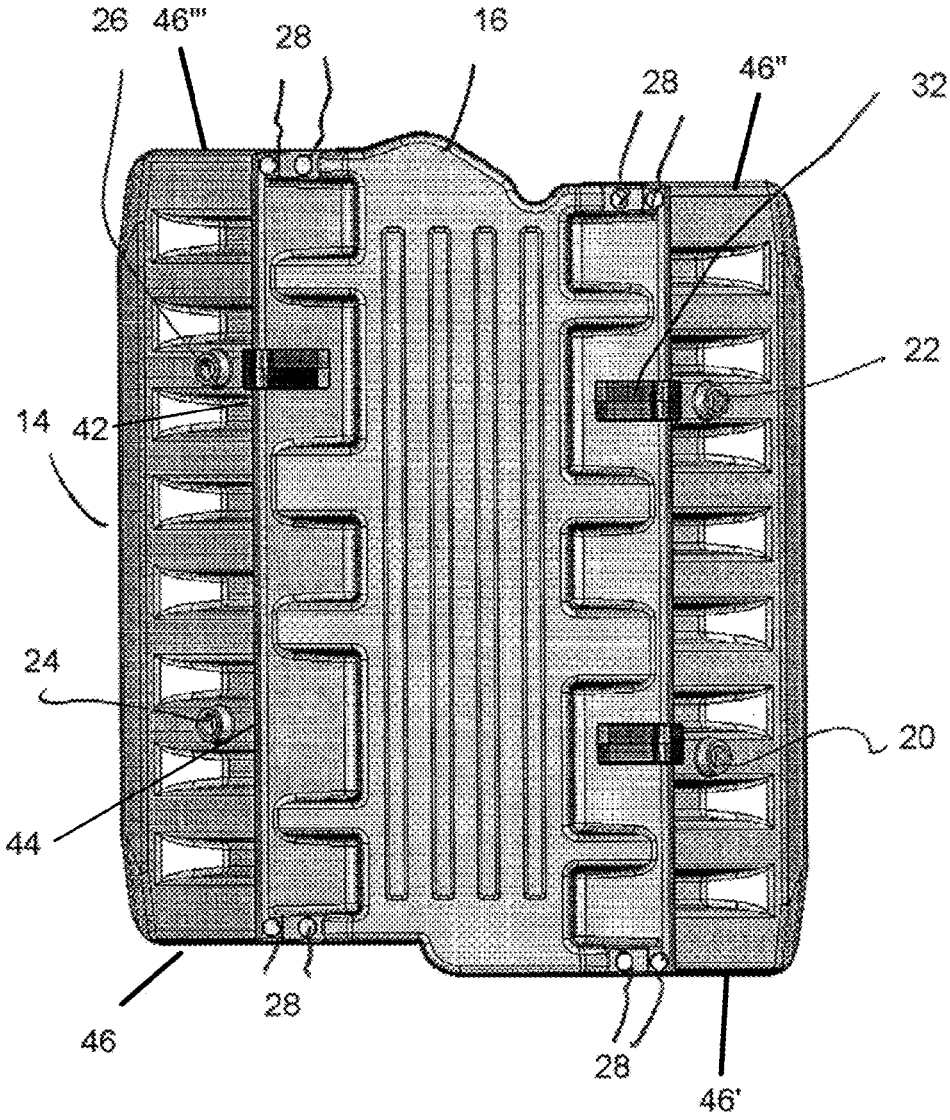
FIG. 5 is a top view of the cover of FIG. 1.
Figure 6:
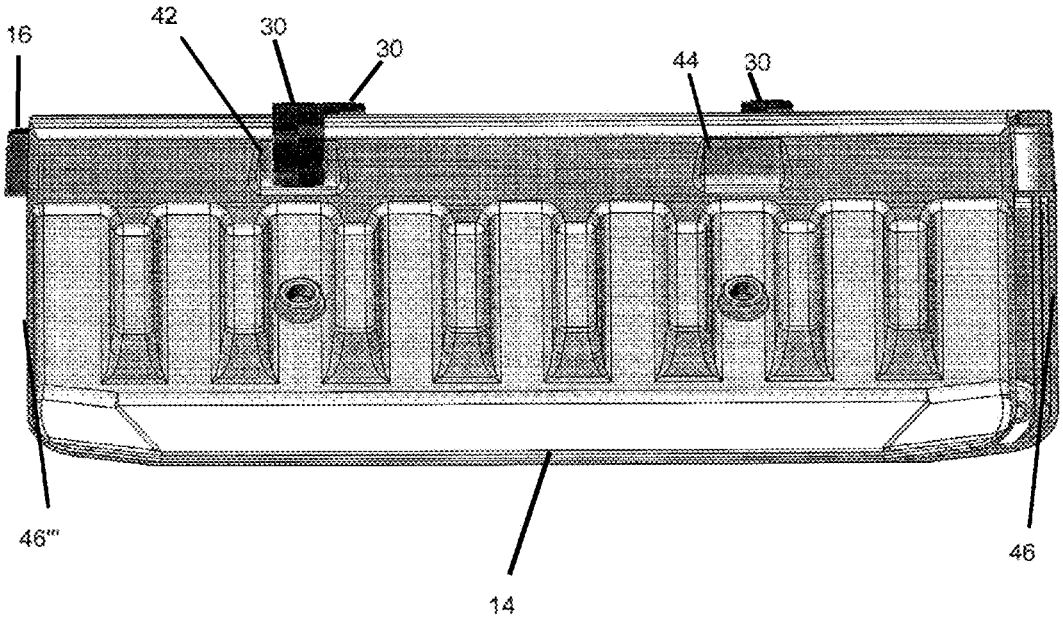
FIG. 6 is a right side view of the cover of FIG. 1.
Figure 7:
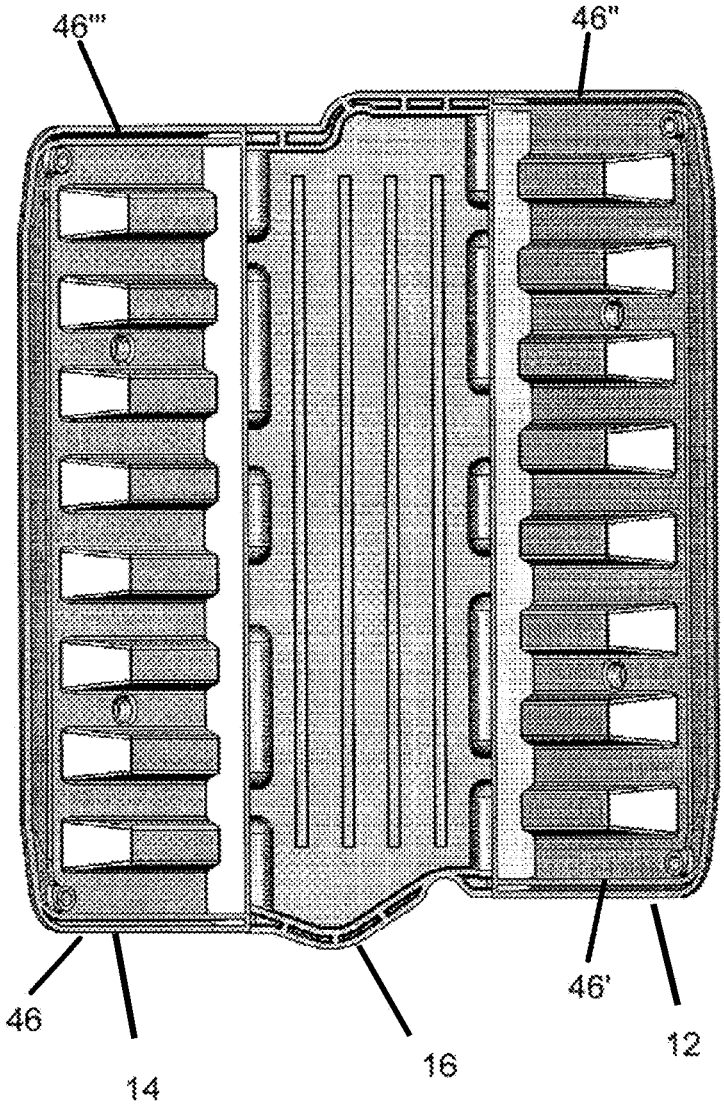
FIG. 7 is a bottom view of the cover of FIG. 1.
Figure 8:
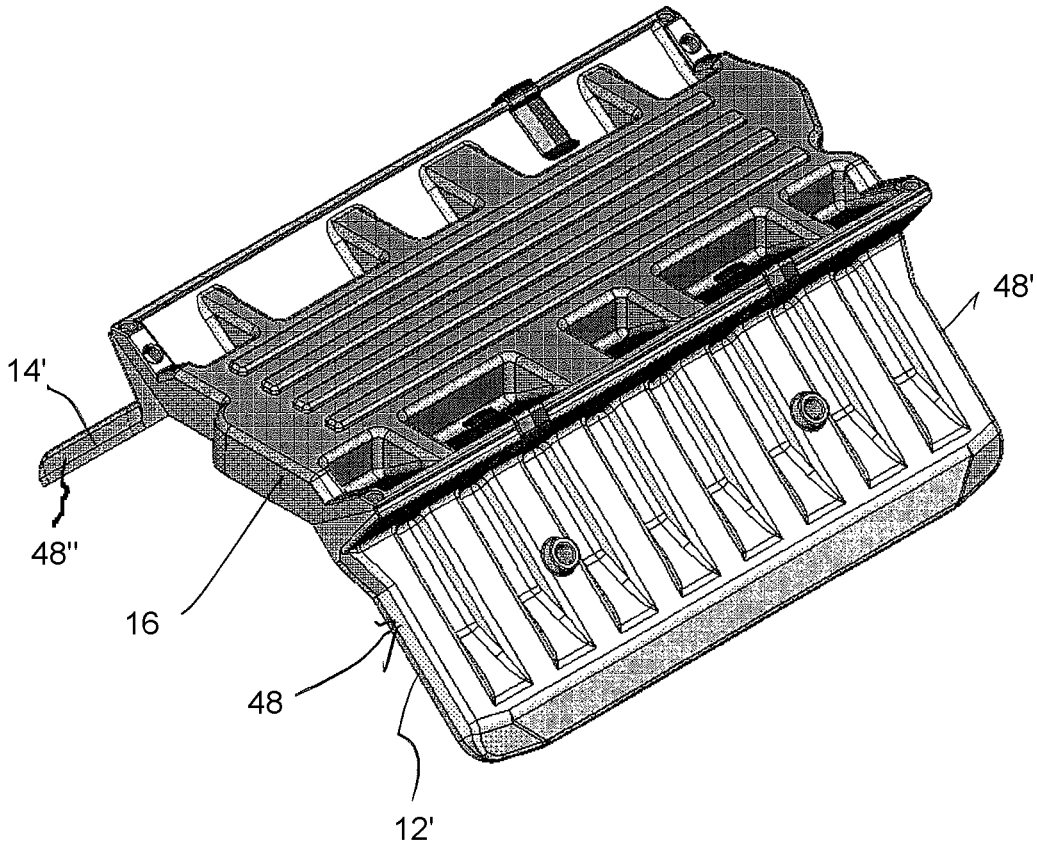
FIG. 8 is a perspective view of an alternative engine block cover.
Figure 9:
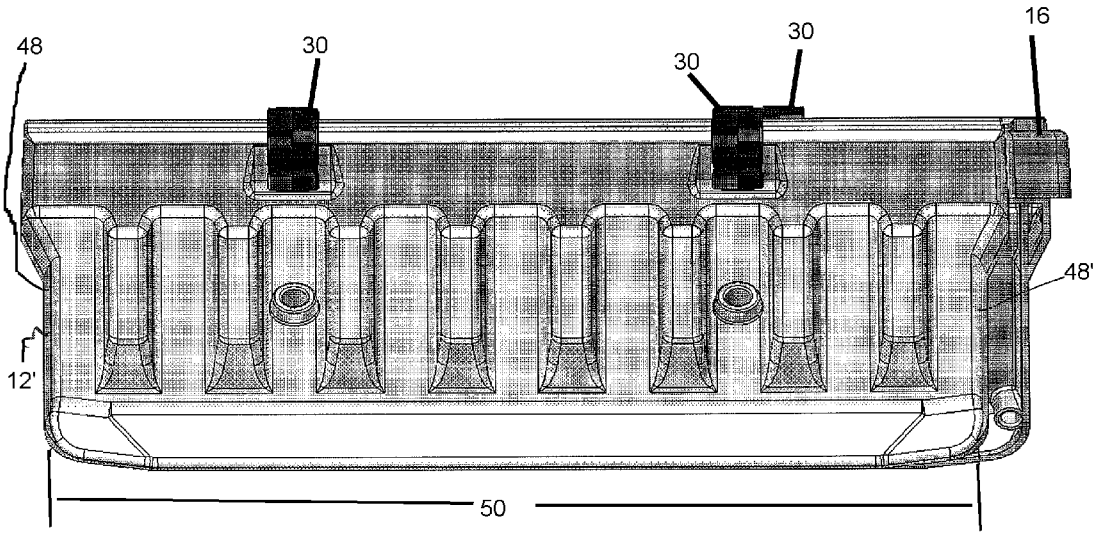
FIG. 9 is a left side view of the cover of FIG. 8.
Figure 10:
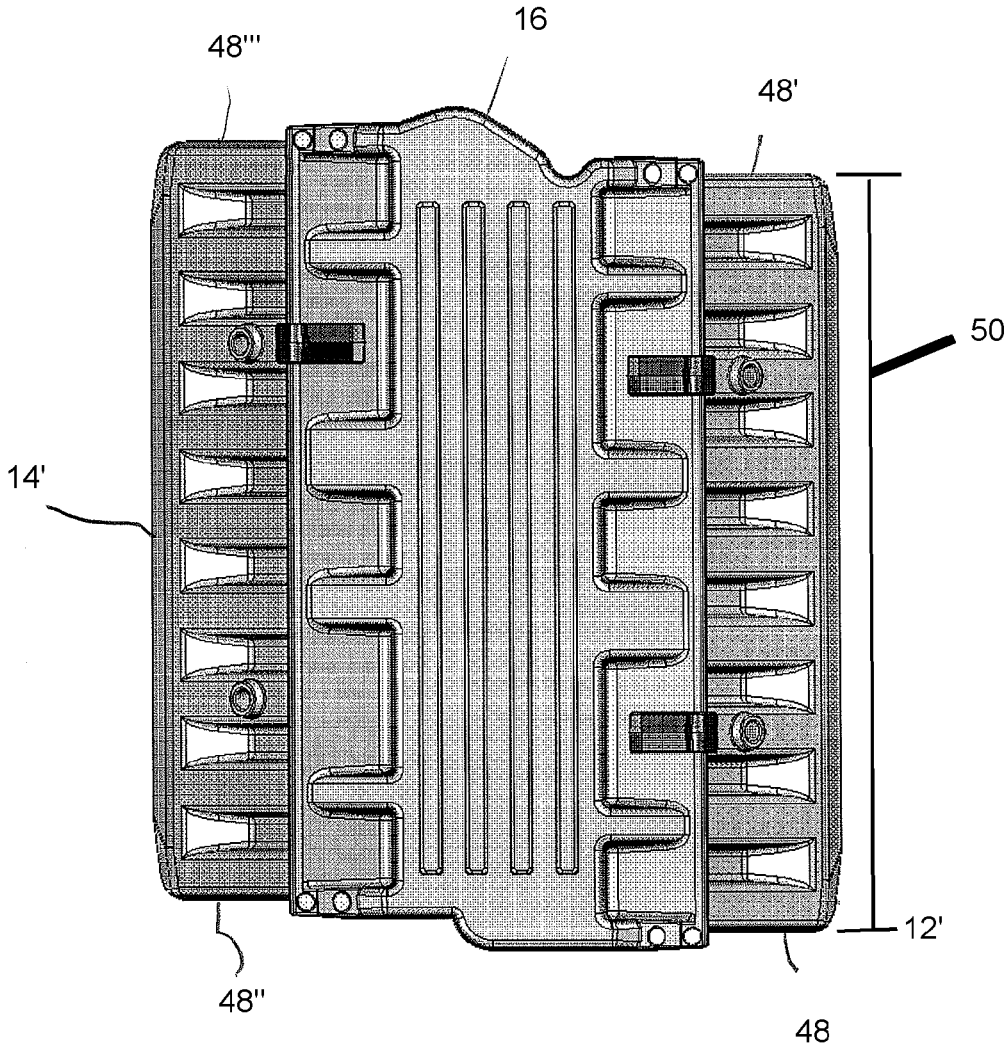
FIG. 10 is a top view of the cover of FIG. 8.
Figure 11:
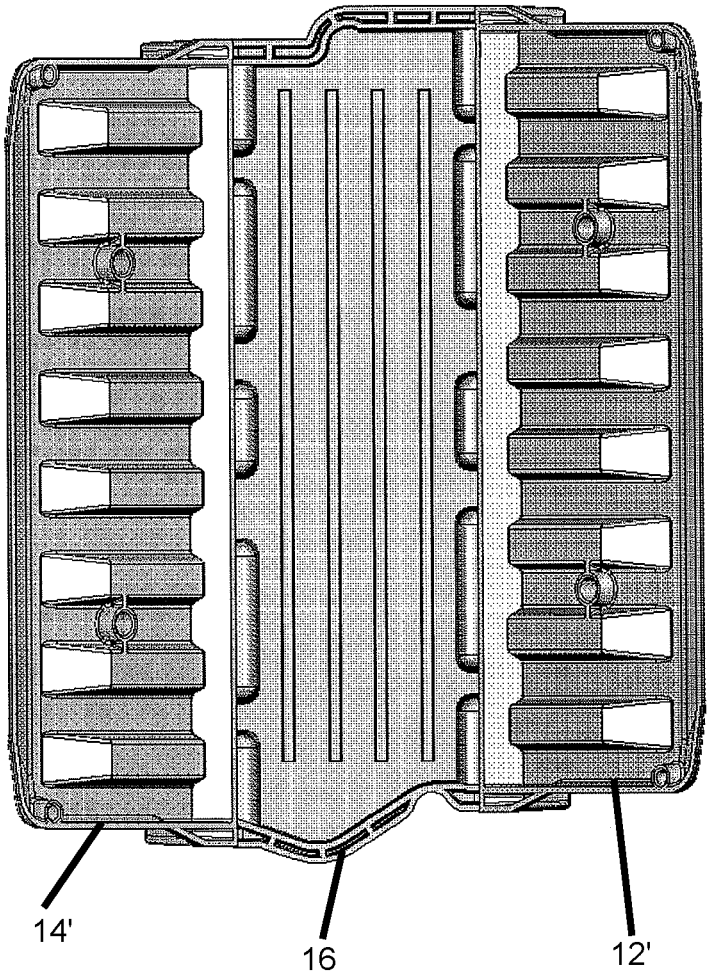
FIG. 11 is a bottom view of the cover of FIG. 8.
Figure 12:
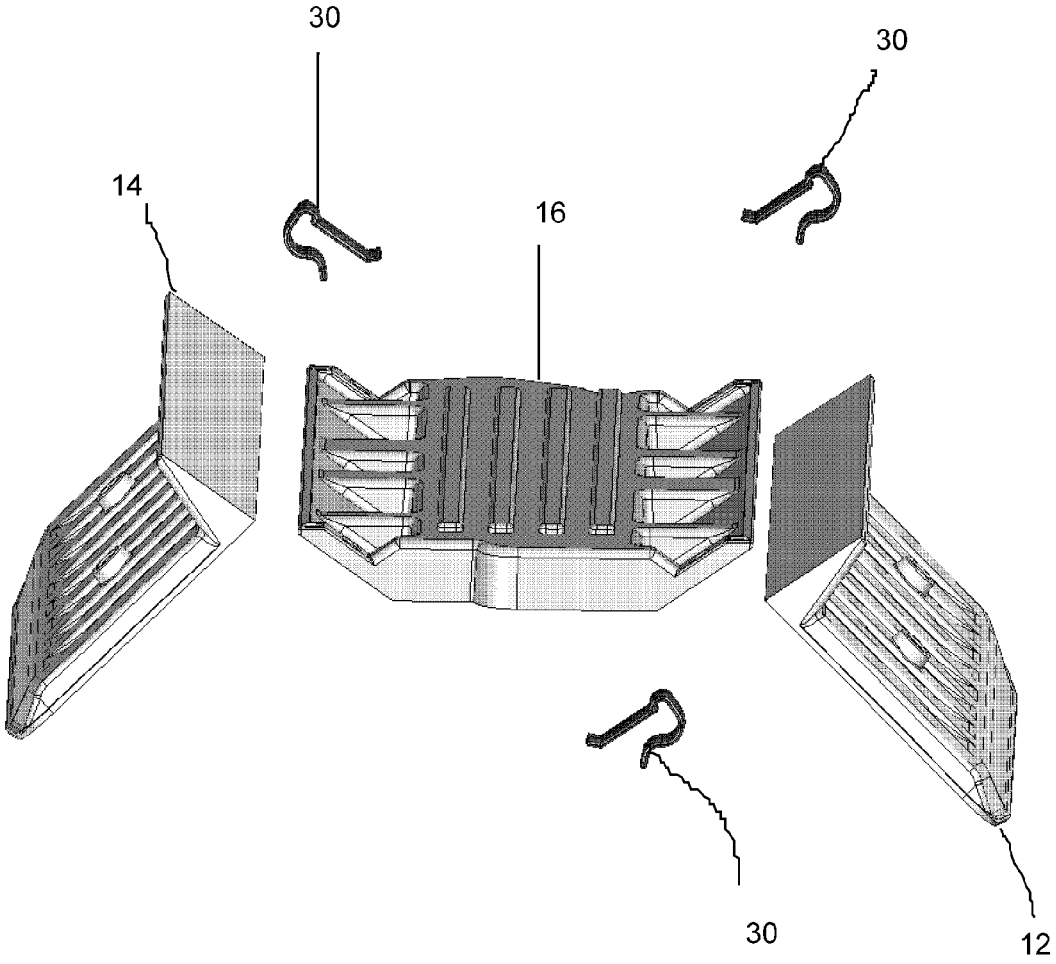
FIG. 12 is an exploded perspective view of components of cam valley cover wings, cam valley cover and clips.

Referring to FIG. 1, a perspective view of an engine block cover apparatus in accordance with the invention, and FIGS. 2-7, the cover includes left and right cam valley cover wings 12, 14 and a cam valley cover 16, adapted for placement on engine block 18 (illustrated in phantom). In the illustrated embodiment, cam valley cover wings 12 and 14 can be identical, but depending on the configuration of the particular engine block, the left and right cover wings can differ to fit the particular side of the engine block.

Cover wing 12 includes front and rear fastener holes 20, 22 positioned to correspond to the position of bolt holes on the engine block, suitably the engine cover bolt holes in the illustrated embodiment. Other cover configurations can employ different fastener hole placement and numbers to correspond to the particular engine block and its position and availability of bolt holes or other features to enable securing of the cover wing to the engine block. Cover wing 14 similarly includes front and rear fastener holes 24, 26 positioned to correspond to bolt or mounting holes in the engine block's right side.

Cam valley cover 16 includes plural mounting fastener receiving holes 28 therein, suitably positioned at respective corners thereof, with 2 such holes at each corner in the illustrated embodiment. The number and placement of holes 28 can be modified to conform to the particular bolt hole pattern of the specific engine block for which the covers are to be used.

Plural cover clips 30 may be provided to act as a fastening clip between the cam valley cover 16 and the cover wings 12, 14 to help secure the cam valley cover to the cover wings. Three such clips are shown in use in the illustrated embodiments. With reference to FIGS. 15 and 16, side and perspective views of a cover clip 30, the clips have an elongate configuration with 2 finger portions 32, 34, having upturned end portions, held together by central portion 36, the clips being biased to urge the finger portions towards one another. Portion 32 is more elongate than portion 34 in the illustrated embodiment. Clip receiving portions 38, 40 are formed in cover 12 on an external face thereof, relative to the face that contacts the engine (visible in FIG. 3) and clip receiving portions 42, 44 are formed in cover 14 on an external face thereof, relative to the face that contacts the engine (visible in FIG. 5) for receiving clip finger portion 34, and a flat region on cover 16 receives the finger portion 32, whereby engagement of the cover 16 with covers 12, 14 may be secured by attaching one or two clips 30 to the covers.

In use the cam valley cover 16 and cover wings 12, 14 are mounted to the engine block to provide a protective cover against entry to foreign material to the engine when the engine is in its 'open' condition without head or manifolds. In the configuration shown in FIG. 1, with both cam valley wings and the cam valley cover being used, clips 30 may be employed to help secure the cover 16 to the cover wings 12, 14.

In particular situations, not all of covers 12, 14 and 16 may be needed. For example, one or both heads may be installed and only the intake manifold is not installed. In such case, the cam valley cover 16 may be used alone (as illustrated in FIG. 14), without the wing covers 12, 14. In such case, the bolt holes 28 on the cam valley cover are used to secure the cover to the engine, by use of bolts through the holes 28 into corresponding bolt holes on the engine.

Figure 17:
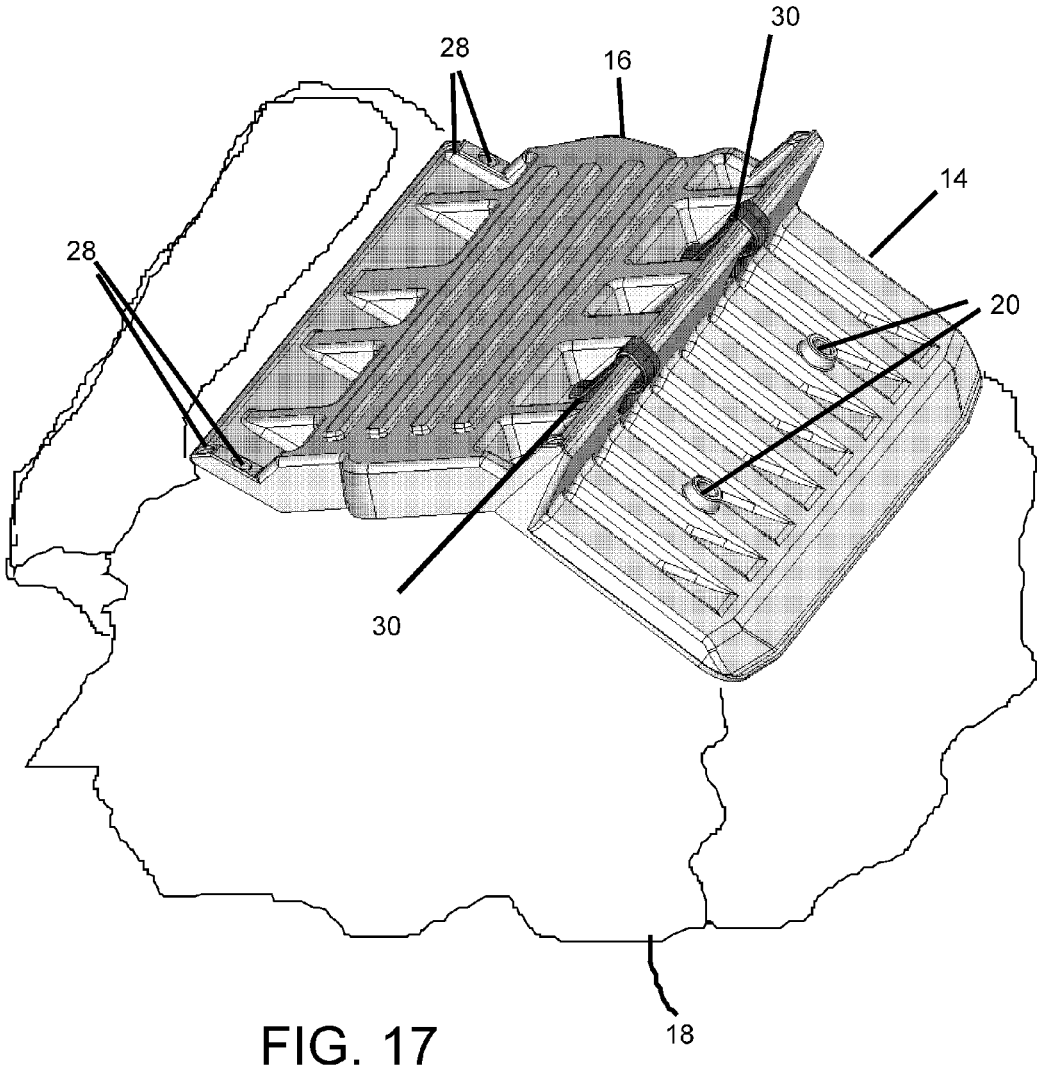
FIG. 17 is a view of an engine block with cam valley cover and a single cam valley wing cover installed.

In the case of use of cover 16 and one of wing covers 12, 14 (as illustrated in FIG. 17), one side of the cover 16 will be secured to the corresponding cover wing 12 or 14 (and to the engine via bolt holes 20) and the other side of cover 16 will be secured to the engine by use of mounting holes 28 and bolts into the engine.

Figure 13:
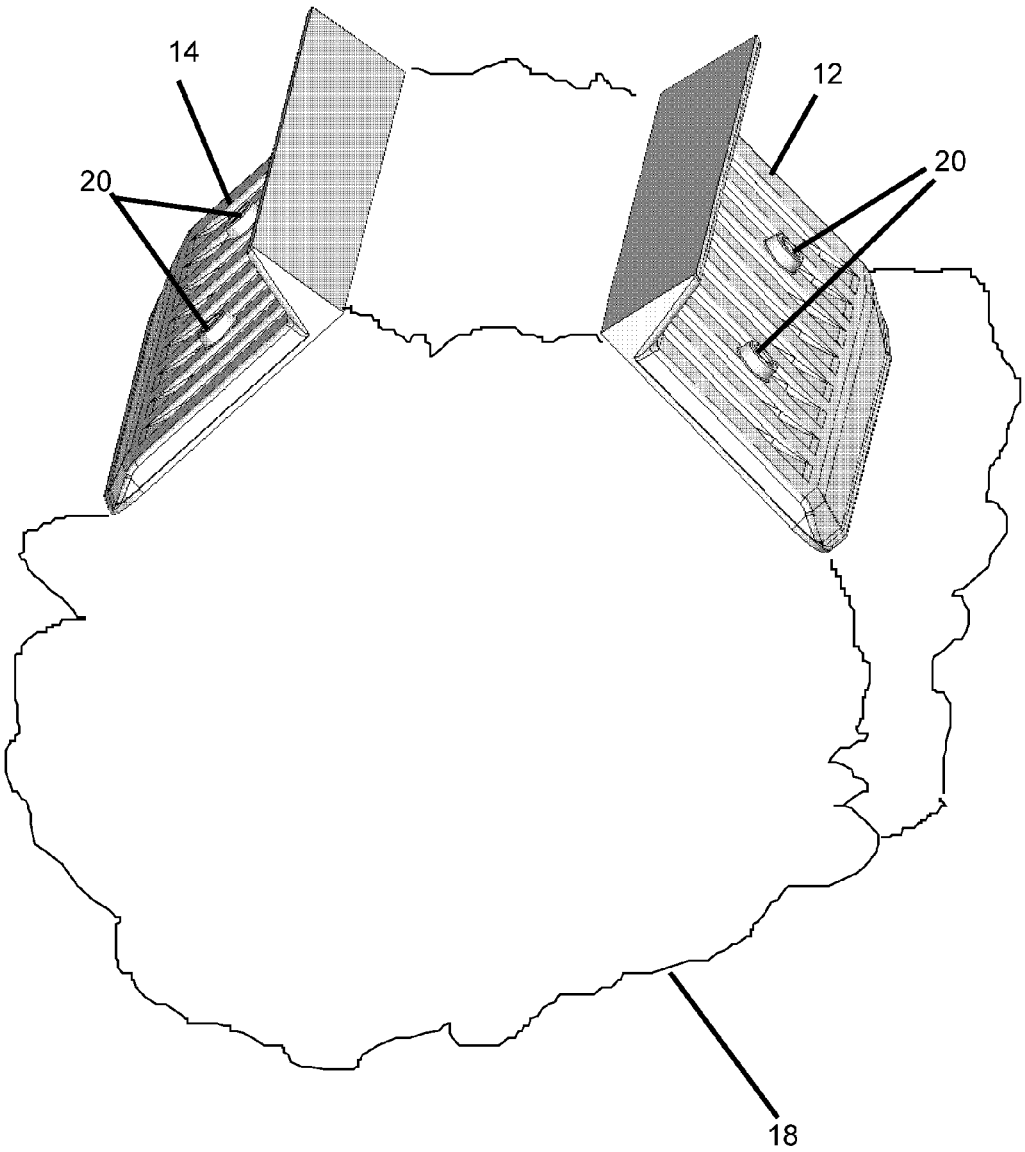
FIG. 13 is a view of 2 cam valley cover wings on an engine block.

FIG. 13 illustrates the case of use of 2 cover wings, without the valley cover 16.

In any configuration, holes 20, 22, 24 and 26 of the covers 12, 14 can receive a bolt therethrough to secure the cover to the engine.

The cover portions 12, 14, 16 are suitably manufactured of a plastic so as to be durable and reusable. Engine manufacturers or rebuilders can charge a deposit or core fee to encourage return of the covers when the end user is finished with the need for the cover for that particular engine, allowing re-use of the cover. Alternatively, the cover may be manufactured of a disposable or recyclable product when return of the cover is not expected.

The embodiment illustrated in FIGS. 1-7 employs wing covers of a particular shape, having a relatively straight front and rear edges 46, 46', 46", 46'". In an alternate embodiment adapted for an engine having a different shape block, with reference to FIGS. 8-11, wing covers 12', 14' have front and rear edges 48, 48', 48", 48'" that are indented slightly so that the overall length 50 of the wing covers 12', 14' is less than the length at a corresponding position of wing covers 12, 14. This difference is to accommodate the different shape of a different engine block, and corresponding changes to other versions of the cover system may be made to fit a specific engine block configuration.

In accordance with the invention, a temporary shield is provided comprising a valley cover shield which covers the area when an intake manifold is removed from an engine, and a pair of deck cover shields for fitting on the engine when one or both heads are removed. The valley cover shield and deck shields may be used in combination or separately as needed for the particular application, whether the intake manifold is removed or whether one or both heads are removed. The covers provide barriers to entry of foreign material for protecting the engine from dirt and the like in the shop and during transit.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. An engine cover system, comprising:

a cam valley cover member;

a first side engine head receiving area cover;

a second side engine head receiving area cover; and at least first and second fastener members for removably securing said cam valley cover member to said first side engine head receiving area cover and said second side engine head receiving area cover, further comprising an engaging member for securing said cam valley cover member with at least one of said first side engine head receiving area cover and said second side engine head receiving area cover, wherein said engaging member for securing said cam valley cover member with at least one of said first side engine head receiving area cover and said second side engine head receiving area cover comprises a clip member, and wherein said clip member has first and second leg portions and said cam valley cover member, said first side engine head receiving area cover and said second side engine head receiving area cover comprises corresponding portions adapted to receive said first and second leg portions of said clip member.

2. An engine cover system, comprising:

a cam valley cover member;

a first side engine head receiving area cover;

a second side engine head receiving area cover; and at least first and second fastener members for removably securing said cam valley cover member to said first side engine head receiving area cover and said second side engine head receiving area cover, further comprising an engaging member for securing said cam valley cover member with at least one of said first side engine head receiving area cover and said second side engine head receiving area cover, wherein said engaging member for securing said cam valley cover member with at least one of said first side engine head receiving area cover and said second side engine head receiving area cover comprises a clip member, and wherein at least one of said first side engine head receiving area cover and said second side engine head receiving area cover include a receiving portion for selective engagement by said clip member.

3. The engine cover system according to claim 2, wherein at least one of said cam valley cover member, said first side engine head receiving area cover are made of plastic.

4. The engine cover system according to claim 2, wherein said cam valley cover and said first side engine head receiving area cover comprise complementary configurations to enable fitting relation with one another.

5. An engine cover system, comprising:

a cam valley cover member;

a first side engine head receiving area cover;

a second side engine head receiving area cover; and at least first and second fastener members for removably securing said cam valley cover member to said first side engine head receiving area cover and said second side engine head receiving area cover, further comprising an engaging member for securing said cam valley cover member with at least one of said first side engine head receiving area cover and said second side engine head receiving area cover, wherein said engaging member for securing said cam valley cover member with at least one of said first side engine head receiving area cover and said second side engine head receiving area cover comprises a clip member, and wherein at least one of said first side engine head receiving area cover and said second side engine head receiving area cover include plural receiving portions for selective engagement by said clip member.

6. An engine cover system, comprising:

a cam valley cover member;

a first side engine head receiving area cover;

a second side engine head receiving area cover;

at least first and second fastener members for removably securing said cam valley cover member to said first side engine head receiving area cover and said second side engine head receiving area cover, said first side engine head receiving area cover and said second side engine head receiving area cover each have at least one fastener receiving feature for temporarily securing said covers to an engine, comprising an aperture formed in the covers for receiving a mounting bolt therethrough to enable said mounting bolt to engage a corresponding bolt hole in the engine, an engaging clip member for securing said cam valley cover member with at least one of said first side engine head receiving area cover and said second side engine head receiving area cover, wherein said cam valley cover member includes a receiving portion for engagement by said clip member and said first side engine head receiving area cover and said second side engine head receiving area cover each include a receiving portion for selective engagement by said clip member.

7. The engine cover system according to claim 6, wherein said clip member has first and second leg portions and said cam valley cover member, said first side engine head receiving area cover and said second side engine head receiving area cover comprises corresponding portions adapted to receive said first and second leg portions of said clip member.

8. The engine cover system according to claim 6, wherein said cam valley cover member, said first side engine head receiving area cover and said second side engine head receiving area cover are made of plastic.

9. The engine cover system according to claim 6 wherein said cam valley cover member, said first side engine head receiving area cover and said second side engine head receiving area cover comprises complementary configurations to enable fitting relation with one another.

10. An engine cover system, comprising:

a cam valley cover member for covering an engine cam valley;

a first side engine head receiving area cover for covering a first engine head mounting area of an engine block when a first engine head has been removed; and at least a first fastener member for removably securing said cam valley cover member to said first side engine head receiving area cover, wherein said fastener member is for removably securing said first side engine head receiving area cover to said cam valley cover member, wherein said first side engine head receiving area cover comprises a first receiving portion for engagement by said fastener member on a face of the first side engine head receiving area cover that is externally exposed to an environment relative to a face of the first side engine head receiving area cover that contacts an engine head and said cam valley cover member comprises a second receiving portion for engagement by said fastener member on a face of the cam valley cover member that is externally exposed to the environment relative to a face of the cam valley cover member that contacts a cam valley.

11. An engine cover system, comprising:

a cam valley cover member for covering an engine cam valley;

a first side engine head receiving area cover for covering a first engine head mounting area of an engine block when a first engine head has been removed; and at least a first fastener member for removably securing said cam valley cover member to said first side engine head receiving area cover, further comprising at least a second one of said first fastener members and a second side engine head receiving area cover for covering a second engine head mounting area of the engine block when a second engine head has been removed, wherein said second side engine head receiving area cover comprises a third receiving portion for engagement by the second one of said first fastener members, wherein said at least a second one of said first fastener members is for removably securing said second side engine head receiving area cover to said cam valley cover member, wherein said second side engine head receiving area cover comprises a first receiving portion for engagement by said at least a second one of said first fastener members on a face of the second side engine head receiving area cover that is externally exposed to an environment relative to a face of the second side engine head receiving area cover that contacts an engine head and said cam valley cover member comprises a second receiving portion for engagement by said at least a second one of said first fastener members on a face of the cam valley cover member that is externally exposed to the environment relative to a face of the cam valley cover member that contacts a cam valley.

* * * * *